US010577767B2

(12) United States Patent
Magnotti et al.

(10) Patent No.: US 10,577,767 B2
(45) Date of Patent: Mar. 3, 2020

(54) IN-SITU PILING AND ANCHOR SHAPING USING PLASMA BLASTING

(71) Applicant: Petram Technologies, Inc., Cambridge, MA (US)

(72) Inventors: Frank A. Magnotti, Millburn, NJ (US); Igor S. Alexandrov, New York, NY (US)

(73) Assignee: Petram Technologies, Inc., Jersey City, NJ (US)

( * ) Notice: Subject to any disclaimer, the term of this patent is extended or adjusted under 35 U.S.C. 154(b) by 0 days.

(21) Appl. No.: 16/279,914

(22) Filed: Feb. 19, 2019

(65) Prior Publication Data

US 2019/0177944 A1 Jun. 13, 2019

Related U.S. Application Data

(60) Provisional application No. 62/632,833, filed on Feb. 20, 2018.

(51) Int. Cl.
*E02D 5/44* (2006.01)
*E02D 7/12* (2006.01)
(Continued)

(52) U.S. Cl.
CPC ..... *E02D 5/36* (2013.01); *E21B 7/15* (2013.01); *E21B 7/28* (2013.01); *H05H 1/2406* (2013.01);
(Continued)

(58) Field of Classification Search
CPC ..... E02D 5/36; E02D 2300/002; E02D 2250/0023; H05H 1/52; H05H 1/2406;
(Continued)

(56) References Cited

U.S. PATENT DOCUMENTS 3,324,665 A * 6/1967 Robichaux ..... E02D 5/54 405/244
3,553,969 A * 1/1971 Chamberlin et al. ..... B63B 35/4406 405/210
(Continued)

FOREIGN PATENT DOCUMENTS

RU 2144980 C1 1/2000
RU 2184221 C1 6/2002
(Continued)

OTHER PUBLICATIONS

Eric P. Koehler, "Thixotropy of SCC and Its Effects on Formwork Pressure", Apr. 14, 2013, https://www.concrete.org/portals/0/files/pdf/webinars/koehler1.pdf (Year: 2013).*

*Primary Examiner* — Benjamin F Fiorello
*Assistant Examiner* — Edwin J Toledo-Duran
(74) *Attorney, Agent, or Firm* — Richard A. Baker, Jr.

(57) ABSTRACT

A method, system and apparatus for plasma blasting comprises a borehole in soil, a blast probe comprising a high voltage electrode and a ground electrode separated by a dielectric separator, wherein the high voltage electrode and the dielectric separator constitute an adjustable probe tip, and an adjustment unit coupled to the adjustable probe tip, wherein the adjustment unit is configured to selectively extend or retract the adjustable probe tip relative to the ground electrode and a blasting media, wherein at least a portion of the high voltage electrode and the ground electrode are submerged in the blast media. The blasting media comprises wet concrete. The adjustable tip permits fine-tuning of the blast. The blast is used to force the wet concrete into a customized shape within the borehole.

19 Claims, 8 Drawing Sheets

(51) Int. Cl.

| | |
|---|---|
| ***E02D 5/36*** | (2006.01) |
| ***H05H 1/24*** | (2006.01) |
| ***E21B 7/15*** | (2006.01) |
| ***E21B 7/28*** | (2006.01) |
| ***H05H 1/52*** | (2006.01) |

(52) U.S. Cl.
CPC ..... *H05H 1/52* (2013.01); *E02D 2250/0023* (2013.01); *E02D 2300/002* (2013.01); *H05H 2001/2412* (2013.01)

(58) Field of Classification Search
CPC ..... H05H 2001/2412; E21B 7/28; E21B 7/15; E21B 43/24; E21B 43/243; E21B 43/2401; E21B 43/247; E21B 43/30; E21B 36/04; E21B 17/028; E21B 47/065; E21B 43/168; E21B 43/166
USPC ..... 405/229–257; 299/14, 16; 175/16; 166/63, 219; 102/313, 327
See application file for complete search history.

(56) References Cited

U.S. PATENT DOCUMENTS 3,628,146 A * 12/1971 Beckman ..... H04B 1/20 455/142
3,679,007 A * 7/1972 O'Hare ..... E21B 7/15 175/16
3,763,610 A * 10/1973 Ballew ..... E02D 5/80 52/160
3,896,917 A * 7/1975 Taplin ..... B41J 3/51 400/131
4,074,758 A * 2/1978 Scott ..... E21B 17/003 166/177.1
4,169,503 A * 10/1979 Scott ..... E21B 17/003 166/177.1
4,222,684 A * 9/1980 Rosenstock ..... E02D 5/76 405/232
4,268,192 A * 5/1981 Colle ..... E02D 5/20 405/239
4,345,650 A * 8/1982 Wesley ..... E21B 36/04 166/177.2
4,465,401 A * 8/1984 Stoddord ..... E21B 33/138 299/11
4,479,680 A * 10/1984 Wesley ..... E21B 43/26 166/249
4,653,697 A * 3/1987 Codina ..... B02C 19/18 241/1
4,741,405 A * 5/1988 Moeny ..... E21B 7/15 175/16
4,806,153 A * 2/1989 Sakai ..... E02D 1/022 175/50
5,004,050 A * 4/1991 Sizonenko ..... E21B 43/003 166/248
5,106,164 A * 4/1992 Kitzinger ..... E21B 7/007 166/63
5,301,169 A * 4/1994 Baria ..... G01V 1/157 181/106
5,388,521 A * 2/1995 Coursen ..... F42D 1/00 102/311
5,397,961 A * 3/1995 Ayers ..... H05H 1/24 315/111.21
5,416,391 A * 5/1995 Correa ..... H01J 17/063 307/106
5,425,570 A * 6/1995 Wilkinson ..... E21B 7/15 166/299
5,482,357 A * 1/1996 Wint ..... E21C 37/18 299/14
5,573,307 A * 11/1996 Wilkinson ..... E21B 7/15 299/14
5,773,750 A * 6/1998 Jae ..... F42D 3/00 102/302
5,980,446 A * 11/1999 Loomis ..... B09B 1/00 405/129.45
6,012,874 A * 1/2000 Groneck ..... E02D 5/38 405/239
6,227,293 B1 * 5/2001 Huffman ..... E21B 28/00 166/177.2
6,283,555 B1 * 9/2001 Arai ..... F42D 3/00 299/14
6,457,778 B1 * 10/2002 Chung ..... E21C 37/18 175/16
6,490,527 B1 * 12/2002 Utt ..... E21B 47/00 175/50
6,499,536 B1 * 12/2002 Ellingsen ..... E21B 43/003 166/248
6,597,632 B2 * 7/2003 Khan ..... G01V 1/288 367/32
6,761,416 B2 * 7/2004 Moeny ..... E21C 37/16 175/16
6,772,105 B1 * 8/2004 Heck, Sr. ..... E21C 37/16 102/311
6,935,702 B2 * 8/2005 Okazaki ..... B02C 19/18 299/13
7,562,740 B2 * 7/2009 Ounadjela ..... G01V 1/143 181/113
7,849,919 B2 * 12/2010 Wood ..... H05H 1/52 102/327
8,616,302 B2 * 12/2013 Moeny ..... E21B 7/15 175/1
8,628,146 B2 * 1/2014 Baltazar-Lopez ..... E21C 37/18 299/14
8,789,772 B2 * 7/2014 Moeny ..... B02C 19/18 241/1
9,181,788 B2 * 11/2015 Ageev ..... E21B 28/00
9,719,302 B2 * 8/2017 Linyaev ..... E21B 7/15
9,739,574 B1 * 8/2017 Vijay ..... F41H 11/18
9,770,724 B2 * 9/2017 Vijay ..... B05B 1/08
9,816,356 B2 * 11/2017 Ageev ..... E21B 43/2405
9,896,917 B2 * 2/2018 Sizonenko ..... E21B 43/16
10,060,195 B2 * 8/2018 Moeny ..... E21B 7/15
10,254,499 B1 * 4/2019 Cohen ..... B33Y 70/00
10,280,723 B2 * 5/2019 Ageev ..... E21B 43/003
10,407,995 B2 * 9/2019 Moeny ..... E21B 7/15
2001/0011590 A1 * 8/2001 Thomas ..... E21B 43/003 166/248
2006/0038437 A1 * 2/2006 Moeny ..... B23H 1/08 299/14
2007/0292215 A1 * 12/2007 Kim ..... E02D 5/445 405/232
2010/0270038 A1 * 10/2010 Looney ..... E21B 43/247 166/402
2011/0139441 A1 * 6/2011 Zolezzi Garreton ..... E21B 43/003 166/249
2011/0227395 A1 * 9/2011 Baltazar-Lopez ..... E21C 37/18 299/14
2012/0043075 A1 * 2/2012 Abramova ..... E21B 43/003 166/249
2014/0027110 A1 * 1/2014 Ageev ..... E21B 43/003 166/249
2014/0251599 A1 * 9/2014 Linetskiy ..... E21B 43/2401 166/248
2016/0168815 A1 * 6/2016 Kemp ..... E04H 12/20 52/157
2017/0002535 A1 * 1/2017 Surjaatmadja ..... E02D 3/12

FOREIGN PATENT DOCUMENTS

RU 2194846 C2 12/2002
RU 2199659 C1 2/2003
RU 2213860 C2 10/2003
RU 2261986 C1 10/2005
RU 2272128 C1 3/2006
RU 2282021 C1 8/2006
RU 2283950 C2 9/2006
RU 2295031 C2 3/2007
RU 2298641 C2 5/2007

(56) References Cited

FOREIGN PATENT DOCUMENTS

| | | | |
|---|---|---|---|
| RU | 2298642 | C2 | 5/2007 |
| RU | 2314412 | C1 | 1/2008 |
| RU | 2317409 | C1 | 2/2008 |
| RU | 2327027 | C2 | 6/2008 |
| RU | 2007101698 | A | 7/2008 |
| RU | 2335658 | C2 | 10/2008 |
| RU | 2520672 | C2 | 4/2014 |

* cited by examiner

IN-SITU PILING AND ANCHOR SHAPING USING PLASMA BLASTING

CROSS REFERENCE TO RELATED APPLICATIONS

This patent application is a non-provisional application of, and claims the benefit of the filing dates of, U.S. Provisional Patent Application 62/632,833, "In-situ Piling and Anchor Shaping using Plasma Blasting", filed on Feb. 20, 2018. The disclosures of this provisional patent application is incorporated herein by reference.

This provisional application draws from U.S. Pat. No. 8,628,146, filed by Martin Baltazar-Lopez and Steve Best, issued on Jan. 14, 2010, entitled "Method of and apparatus for plasma blasting". The entire patent incorporated herein by reference.

BACKGROUND

Technical Field

The present invention relates to the field of concrete piling construction. More specifically, the present invention relates to the field of concrete piling construction using plasma blasting.

Description of the Related Art

In the building trades, a deep foundation is a type of foundation that transfers building loads to the earth farther down from the surface than a shallow foundation does to a subsurface layer or a range of depths. One method of deep foundation is a pile. A pile or piling is a vertical structural element of a deep foundation, driven or drilled deep into the ground at the building site.

There are many reasons that a geotechnical engineer would recommend a deep foundation over a shallow foundation, such as for a skyscraper. Some of the common reasons are very large design loads, a poor soil at shallow depth, or site constraints like property lines. There are different terms used to describe different types of deep foundations including the pile (which is analogous to a pole), the pier (which is analogous to a column), drilled shafts, and caissons. Piles are generally driven into the ground in situ; other deep foundations are typically put in place using excavation and drilling.

When using Cast-in-Situ piles, a borehole is drilled into the ground, then concrete (and often some sort of reinforcing) is placed into the borehole to form the pile. Rotary boring techniques allow larger diameter piles than any other piling method and permit pile construction through particularly dense or hard strata. Construction methods depend on the geology of the site; in particular, whether boring is to be undertaken in 'dry' ground conditions or through water-saturated strata. Casing is often used when the sides of the borehole are likely to slough off before concrete is poured.

For end-bearing piles, drilling continues until the borehole has extended a sufficient depth (socketing) into a sufficiently strong layer. Depending on site geology, this can be a rock layer, or hardpan, or other dense, strong layers. Both the diameter of the pile and the depth of the pile are highly specific to the ground conditions, loading conditions, and nature of the project. Pile depths may vary substantially across a project if the bearing layer is not level.

However, piles must be sunk to a depth where a layer is found where the soil can support the load of the building.

This can be quite expensive in locations where the bedrock is particularly deep. Methodologies for creating a base strong enough to support the building for a reasonable cost are needed in the industry.

Plasma blasting allows for the distribution of material at the bottom of a piling hole, and at different levels, spreading the load over a broader area, optimizing the shape of the piling, and allowing for increased weight on each piling.

The present invention eliminates the issues articulated above as well as other issues with the currently known products.

SUMMARY OF THE INVENTION

A method of creating a piling and/or anchor in soil, utilizing the steps of first creating a borehole in the soil, then filling the borehole with wet concrete (and in some cases, reinforcement steel rebar), and next inserting a plasma blasting probe into the borehole. The plasma blasting probe then creates a plasma explosion in the borehole, expanding the wet concrete into the surrounding soil. In some embodiments, rebar is also inserted. The plasma blasting probe is then removed from the borehole and additional concrete is added into the borehole to create the piling. For larger boreholes, the process can be repeated stepwise in increments from the bottom of the hole to approximately half way up the hole creating multiple wet concrete expansion areas.

In some embodiments, a plurality of boreholes are created in close proximity such that the concrete in at least two boreholes interconnects. This set of boreholes could form a lattice. The plasma explosion could be shaped to create a mushroom shape, and guy wire attachments could be inserted in the concrete. In some embodiments, the method also includes the step of calculating an amount of energy, a duration of energy and a gap between electrodes mounted in the plasma blasting probe to form a specific shape with the plasma explosion. This calculation could be performed by a special purpose microprocessor. This microprocessor could also calculate the depth of the plasma explosion. The microprocessor could electronically adjusting the amount of energy and the duration of energy. The plasma blasting probe could include a symmetrical cage, and could include a plurality of electrodes. The electrodes are connected to at least one capacitor. The electrodes are separated by a dielectric separator, and the dielectric separator and the electrodes constitute an adjustable probe tip with a maximum gap between the electrodes less than the gap between any of the electrodes and the cage enclosing the electrodes. The electrodes are on an axis with tips opposing each other.

A blast probe apparatus for forming shaped concrete pilings is also described herein. The blast probe apparatus includes a symmetrical cage and a plurality of electrodes. The electrodes are connected to at least one capacitor. The electrodes are separated by a dielectric separator, and the dielectric separator and the electrodes constitute an adjustable probe tip with a maximum gap between the electrodes less than the gap between any of the electrodes and the cage enclosing the electrodes. The electrodes are on an axis with tips opposing each other. The blast probe apparatus also includes at least one soil condition sensor attached to the symmetrical cage. The probe also includes a special purpose microprocessor in communication with the at least one soil condition sensor and the electrodes, wherein the special purpose microprocessor controls an amount of energy and a duration of energy sent through the electrodes.

The blast probe apparatus could also include wet concrete in the cage between the electrodes, and could include a motor attached to one of the electrodes and in communication with the special purpose microprocessor.

DETAILED DESCRIPTION OF THE INVENTION

Figure 1:
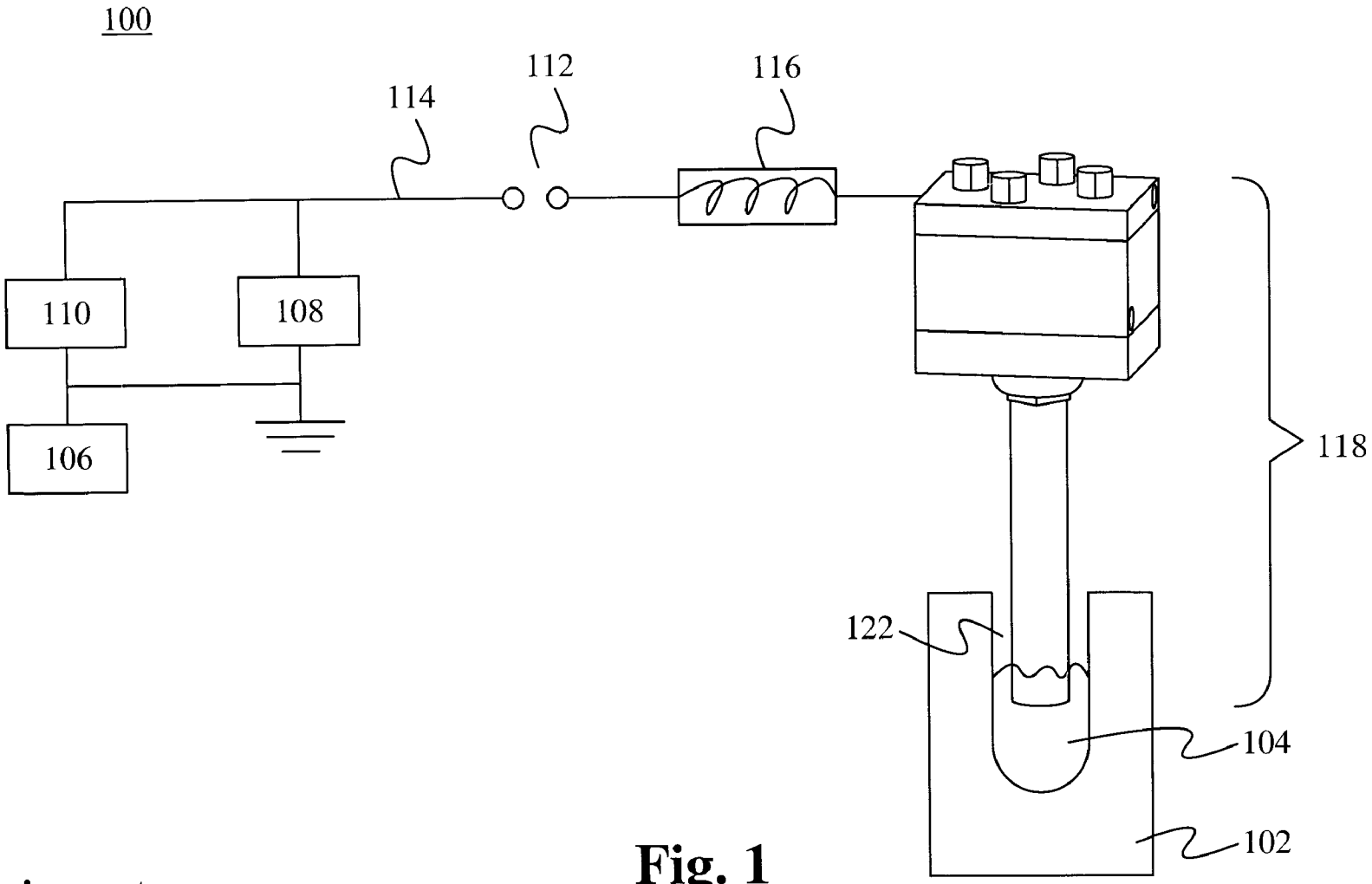
Fig. 1 Prior art
FIG. 1 shows the plasma blasting system in accordance with some embodiments of the Present Application

FIG. 1 illustrates a plasma blasting system 100 for fracturing a solid 102 in accordance with some embodiments where electrical energy is deposited at a high rate (e.g. a few microseconds), into a blasting media 104 (e.g. water or wet concrete), wherein this fast discharge in the blasting media 104 creates plasma confined in a borehole 122 within the solid 102. A pressure wave created by the discharge plasma emanates from the blast region thereby fracturing the solid 102. In some embodiments, rather than fracturing a solid, this technique is used to pack soil at the bottom of a borehole and push wet concrete into the packed soil in order to shape the bottom of a borehole.

In some embodiments, the plasma blasting system 100 comprises a power supply 106, an electrical storage unit 108, a voltage protection device 110, a high voltage switch 112, transmission cable 114, an inductor 116, a blasting probe 118 and a blasting media 104. In some embodiments, the plasma blasting system 100 comprises any number of blasting probes and corresponding blasting media. In some embodiments, the inductor 116 is replaced with the inductance of the transmission cable 114. Alternatively, the inductor 116 is replaced with any suitable inductance means as is well known in the art. The power supply 106 comprises any electrical power supply capable of supplying a sufficient voltage to the electrical storage unit 108. The electrical storage unit 108 comprises a capacitor bank or any other suitable electrical storage means. The voltage protection device 110 comprises a crowbar circuit with voltage-reversal protection means as is well known in the art. The high voltage switch 112 comprises a spark gap, an ignitron, a solid state switch, or any other switch capable of handling high voltages and high currents. In some embodiments, the transmission cable 114 comprises a coaxial cable. Alternatively, the transmission cable 114 comprises any transmission cable capable of adequately transmitting the pulsed electrical power.

In some embodiments, the power supply 106 couples to the voltage protection device 110 and the electrical storage unit 108 via the transmission cable 114 such that the power supply 106 is able to supply power to the electrical storage unit 108 through the transmission cable 114 and the voltage protection device 110 is able to prevent voltage reversal from harming the system. In some embodiments, the power supply 106, voltage protection device 110 and electric storage unit 108 also couple to the high voltage switch 112 via the transmission cable 114 such that the switch 112 is able to receive a specified voltage/current from the electric storage unit 108. The switch 112 then couples to the inductor 116 which couples to the blasting probe 118 again via the transmission cable 114 such that the switch 112 is able to selectively allow the specified voltage/amperage received from the electric storage unit 108 to be transmitted through the inductor 116 to the blasting probe 118.

Figure 2A:
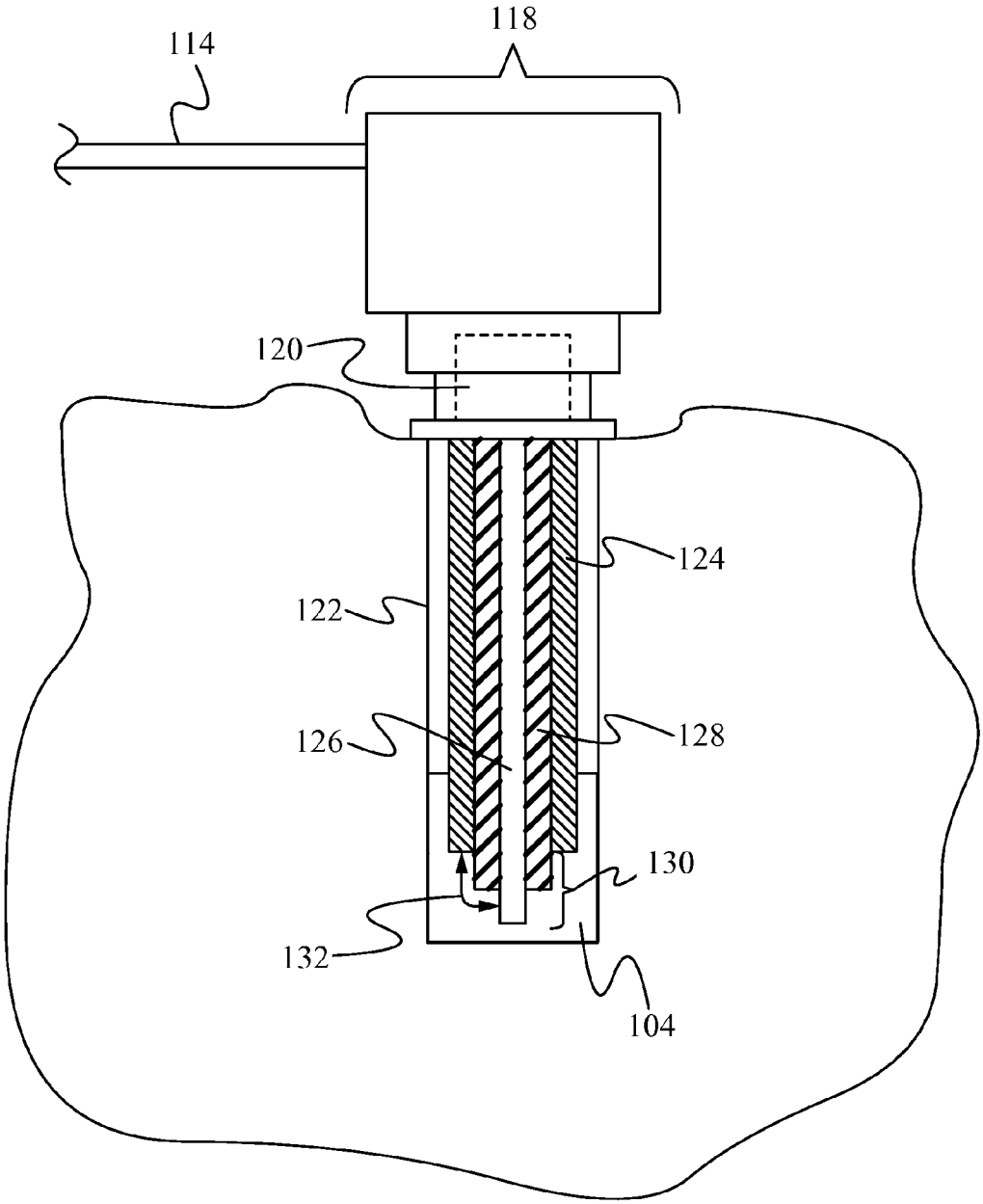
Fig. 2A Prior art
FIG. 2A shows a close up view of the blasting probe in accordance with some embodiments of the Present Application.
Figure 2B:
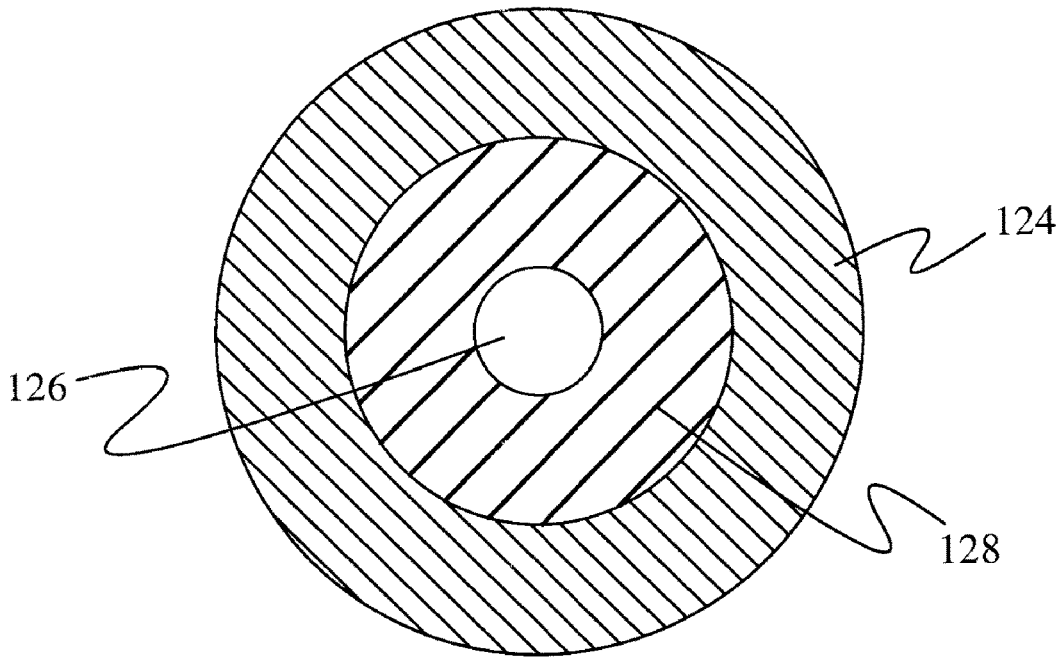
Fig. 2B Prior art
FIG. 2B shows an axial view of the blasting probe in accordance with some embodiments of the Present Application.
Figure 5:
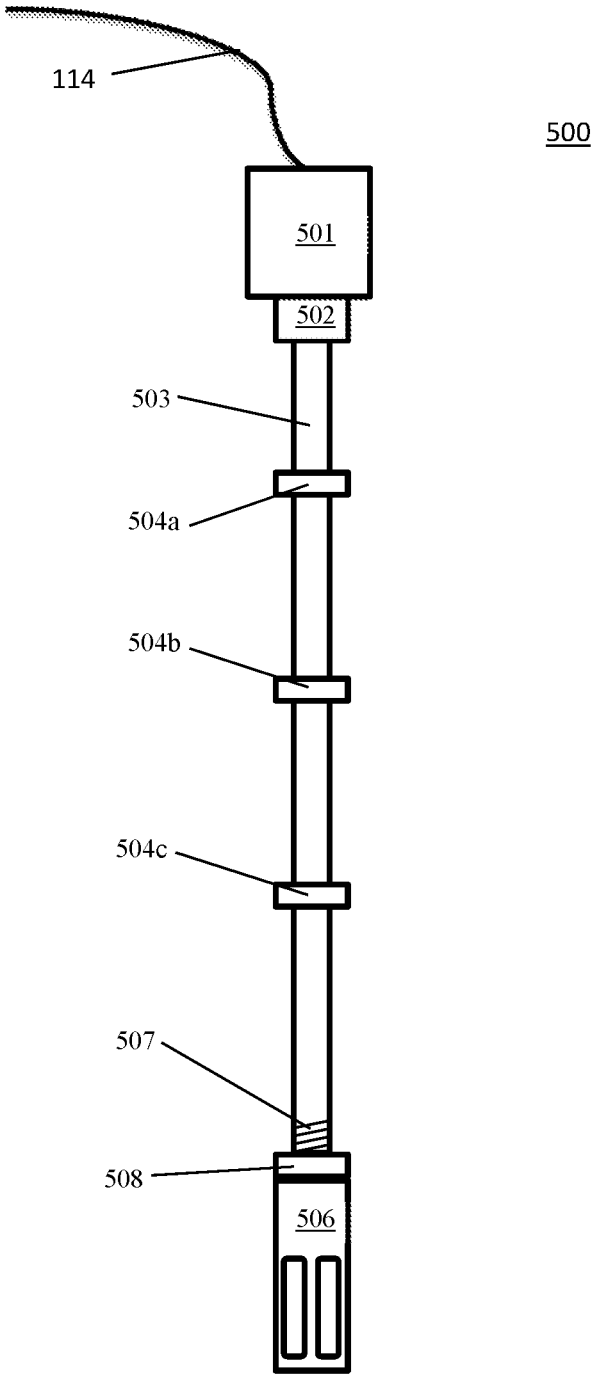
FIG. 5 shows a drawing of the improved probe from the top to the blast tip.
Figure 6:
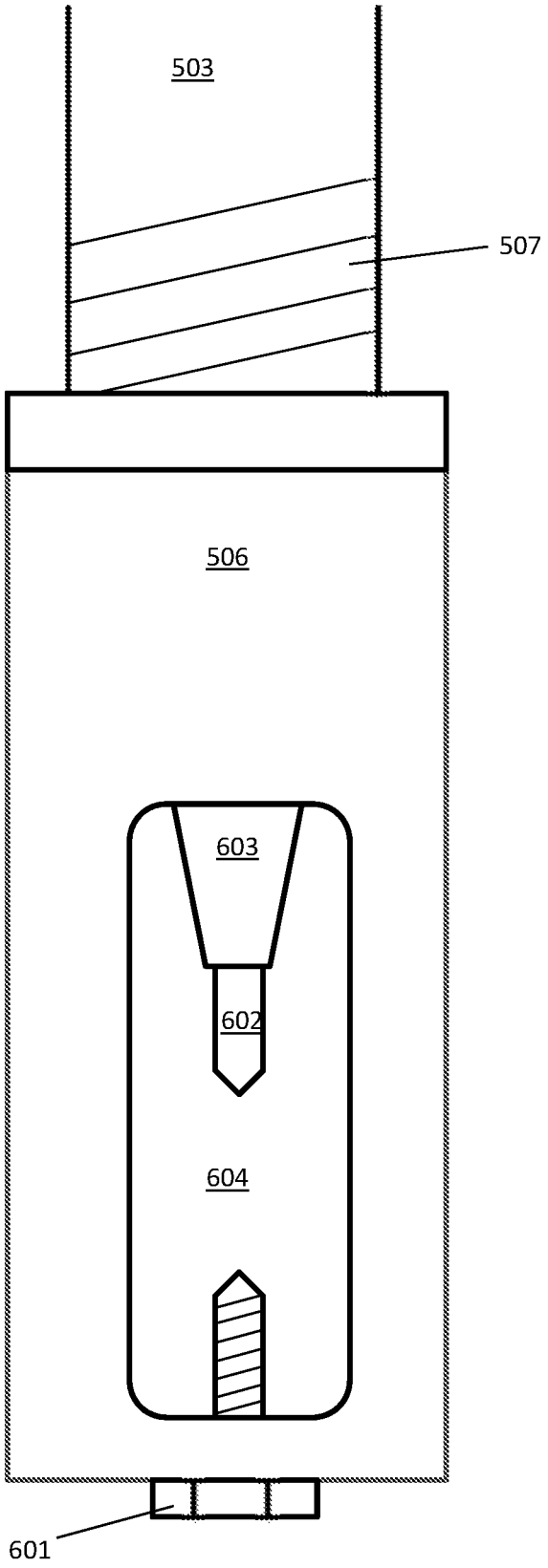
FIG. 6 shows a detailed view into the improved blast tip.

FIG. 2A shows one embodiment for a blasting probe. FIGS. 5 and 6 show another embodiment. As seen in FIG. 2A, the blasting probe 118 comprises an adjustment unit 120, one or more ground electrodes 124, one or more high voltage electrodes 126 and a dielectric separator 128, wherein the end of the high voltage electrode 126 and the dielectric separator 128 constitute an adjustable blasting probe tip 130. The adjustable blasting probe tip 130 is reusable. Specifically, the adjustable blasting probe tip 130 comprises a material and is configured in a geometry such that the force from the blasts will not deform or otherwise harm the tip 130. Alternatively, any number of dielectric separators comprising any number and amount of different dielectric materials are able to be utilized to separate the ground electrode 124 from the high voltage electrode 126. In some embodiments, as shown in FIG. 2B, the high voltage electrode 126 is encircled by the hollow ground electrode 124. Furthermore, in those embodiments the dielectric separator 128 also encircles the high voltage electrode 126 and is used as a buffer between the hollow ground electrode 124 and the high voltage electrode 126 such that the three 124, 126, 128 share an axis and there is no empty space between the high voltage and ground electrodes 124, 126. Alternatively, any other configuration of one or more ground electrodes 124, high voltage electrodes 126 and dielectric separators 128 are able to be used wherein the dielectric separator 128 is positioned between the one or more ground electrodes 124 and the high voltage electrode 126. For example, the configuration shown in FIG. 2B could be switched such that the ground electrode was encircled by the high voltage electrode with the dielectric separator again sandwiched in between, wherein the end of the ground electrode and the dielectric separator would then comprise the adjustable probe tip.

The adjustment unit 120 comprises any suitable probe tip adjustment means as are well known in the art. Further, the adjustment unit 120 couples to the adjustable tip 130 such that the adjustment unit 120 is able to selectively adjust/move the adjustable tip 130 axially away from or towards the end of the ground electrode 124, thereby adjusting the electrode gap 132. In some embodiments, the adjustment unit 120 adjusts/moves the adjustable tip 130 automatically. The term "electrode gap" is defined as the distance between the high voltage and ground electrode 126, 124 through the blasting media 104. Thus, by moving the adjustable tip 130 axially in or out in relation to the end of the ground electrode 124, the adjustment unit 120 is able to adjust the resistance and/or power of the blasting probe 118. Specifically, in an electrical circuit, the power is directly proportional to the resistance. Therefore, if the resistance is increased or decreased, the power is correspondingly varied. As a result, because a change in the distance separating the electrodes 124, 126 in the blasting probe 118 determines the resistance of the blasting probe 118 through the blasting media 104 when the plasma blasting system 100 is fired, this adjustment of the electrode gap 132 is able to be used to vary the electrical power deposited into the solid 102 to be broken or fractured (or into the wet concrete to push the concrete into the borehole wall. Accordingly, by allowing more refined control over the electrode gap 132 via the adjustable tip 130, better control over the blasting and breakage yield is able to be obtained (or for shaping the borehole).

Figure 3:
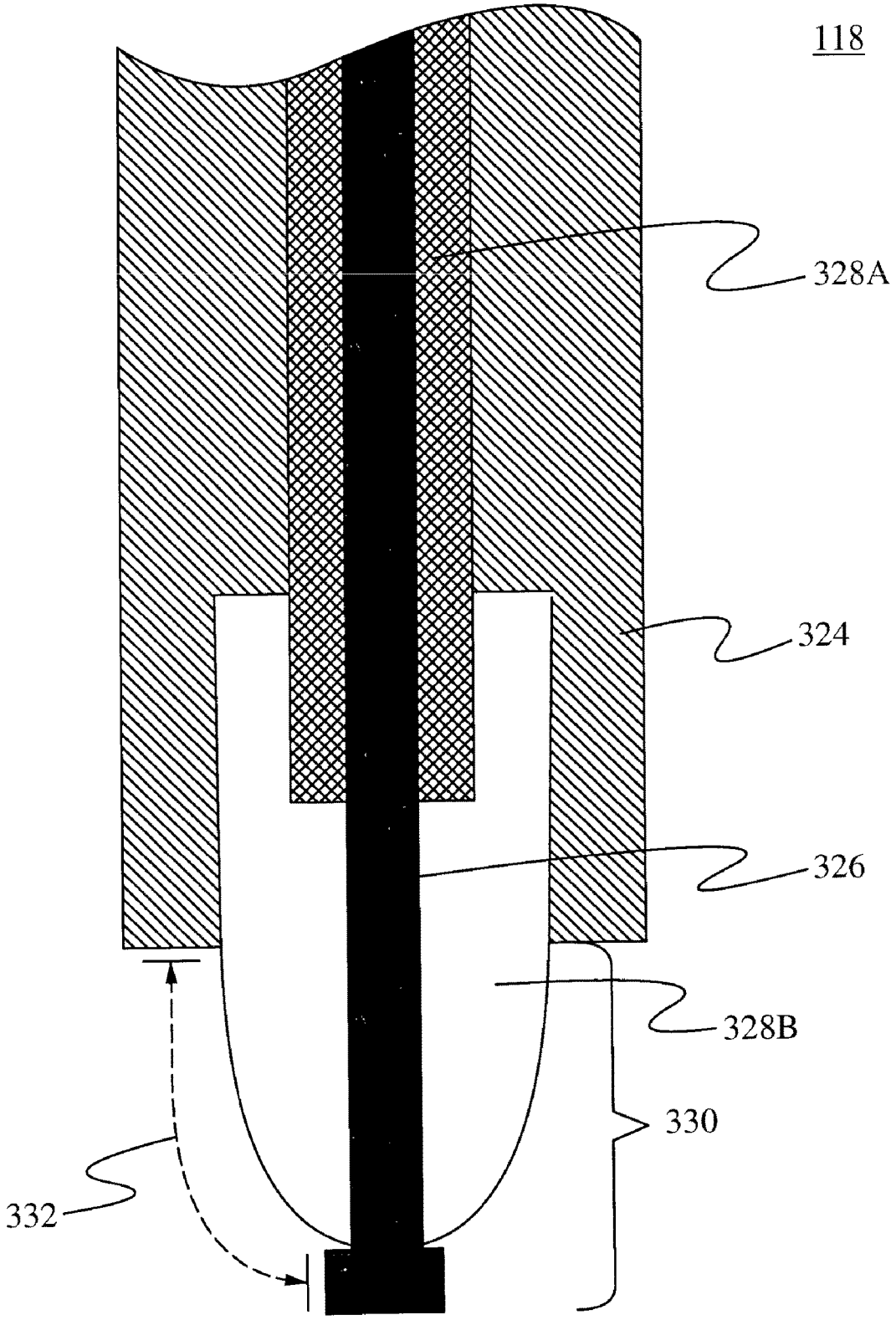
Fig. 3 Prior art
FIG. 3 shows a close up view of the blasting probe comprising two dielectric separators for high energy blasting in accordance with some embodiments of the Present Application.

Another embodiment, as shown in FIG. 3, is substantially similar to the embodiment shown in FIG. 2A except for the differences described herein. As shown in FIG. 3, the blasting probe 118 comprises an adjustment unit (not shown), a ground electrode 324, a high voltage electrode 326, and two different types of dielectric separators, a first dielectric separator 328A and a second dielectric separator 328B. Further, in this embodiment, the adjustable blasting probe tip 330 comprises the end portion of the high voltage electrode 326 and the second dielectric separator 328B. The adjustment unit (not shown) is coupled to the high voltage electrode 326 and the second dielectric separator 328B (via the first dielectric separator 328A), and adjusts/moves the adjustable probe tip 330 axially away from or towards the end of the ground electrode 324, thereby adjusting the electrode gap 332. In some embodiments, the second dielectric separator 328B is a tougher material than the first dielectric separator 328A such that the second dielectric separator 328B better resists structural deformation and is therefore able to better support the adjustable probe tip 330. Similar to the embodiment in FIG. 2A, the first dielectric 328A is encircled by the ground electrode 324 and encircles the high voltage electrode 326 such that all three share a common axis. However, unlike FIG. 2A, towards the end of the high voltage electrode 326, the first dielectric separator 328A is supplanted by a wider second dielectric separator 328B which surrounds the high voltage electrode 326 and forms a conic or parabolic support configuration as illustrated in the FIG. 3. The conic or parabolic support configuration is designed to add further support to the adjustable probe tip 330. Alternatively, any other support configuration could be used to support the adjustable probe tip. Alternatively, the adjustable probe tip 330 is configured to be resistant to deformation. In some embodiments, the second dielectric separator comprises a polycarbonate tip. Alternatively, any other dielectric material is able to be used. In some embodiments, only one dielectric separator is able to be used wherein the single dielectric separator both surrounds the high voltage electrode throughout the blast probe and forms the conic or parabolic support configuration around the adjustable probe tip. In particular, the embodiment shown in FIG. 3 is well suited for higher power blasting, wherein the adjustable blast tip tends to bend and ultimately break. Thus, due to the configuration shown in FIG. 3, the adjustable probe tip 330 is able to be reinforced with the second dielectric material 328B in that the second dielectric material 328B is positioned in a conic or parabolic geometry around the adjustable tip such that the adjustable probe tip 330 is protected from bending due to the blast.

In one embodiment, water is used as the blasting media 104. The water could be poured down the bore hole 122 before or after the probe 118 is inserted in the borehole 122. In some embodiments, such as horizontal boreholes 122 or boreholes 122 that extend upward, the blasting media 104 could be contained in a balloon or could be forced under pressure into the hole with the probe 118. In another embodiment, wet concrete is used as the blasting media 104.

As shown in FIGS. 1 and 2, the blasting media 104 is positioned within the borehole 122 of the solid 102, with the adjustable tip 130 and at least a portion of the ground electrode 124 suspended within the blasting media 104 within the solid 102. Correspondingly, the blasting media 104 is also in contact with the inner wall of the borehole 122 of the solid 102. The amount of blasting media 104 to be used is dependent on the size of the solid and the size of the blast desired and its calculation is well known in the art.

Figure 4:
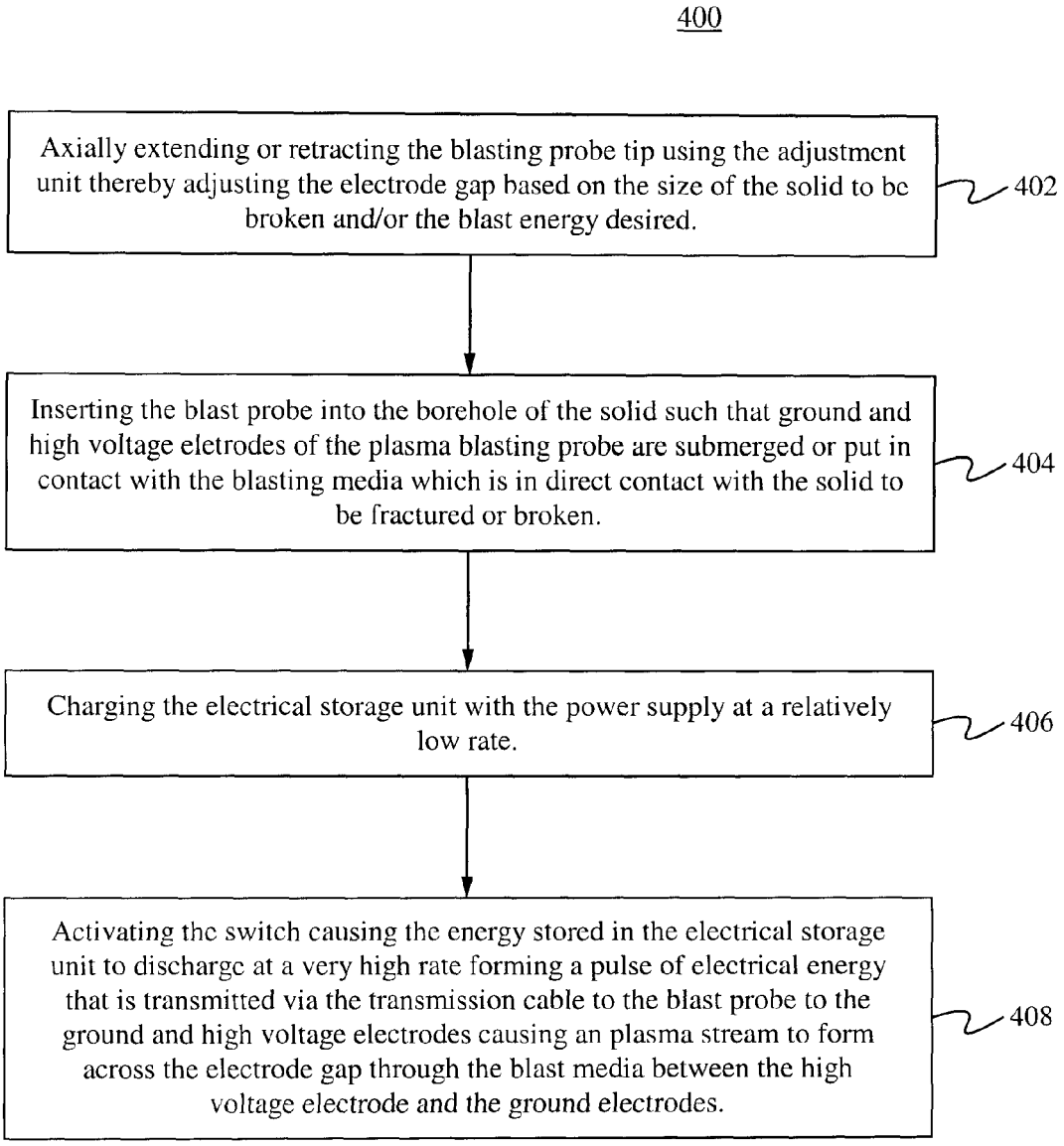
Fig. 4 Prior art
FIG. 4 shows a flow chart illustrating a method of using the plasma blasting system to break or fracture a solid in accordance with some embodiments of the Present Application.

The method and operation 400 of the plasma blasting system 100 will now be discussed in conjunction with a flow chart illustrated in FIG. 4. In operation, as shown in FIGS. 1 and 2, the adjustable tip 130 is axially extended or retracted by the adjustment unit 120 thereby adjusting the electrode gap 132 based on the size of the solid 102 to be broken and/or the blast energy desired at the step 402. The blast probe 118 is then inserted into the borehole 122 of the solid such that at least a portion of the ground and high voltage electrodes 124, 126 of the plasma blasting probe 118 are submerged or put in contact with the blasting media 104 which is in direct contact with the solid 102 to be fractured or broken at the step 404. Alternatively, the electrode gap 132 is able to be adjusted after insertion of the blasting probe 118 into the borehole 122. The electrical storage unit 108 is then charged by the power supply 106 at a relatively low rate (e.g., a few seconds) at the step 406. The switch 112 is then activated causing the energy stored in the electrical storage unit 108 to discharge at a very high rate (e.g. tens of microseconds) forming a pulse of electrical energy (e.g. tens of thousands of Amperes) that is transmitted via the transmission cable 114 to the plasma blasting probe 118 to the ground and high voltage electrodes 124, 126 causing a plasma stream to form across the electrode gap 132 through the blast media 104 between the high voltage electrode 126 and the ground electrode 124 at the step 408.

During the first microseconds of the electrical breakdown, the blasting media 104 is subjected to a sudden increase in temperature (e.g. about 5000 to 10,000° C.) due to a plasma channel formed between the electrodes 124, 126, which is confined in the borehole 122 and not able to dissipate. The heat generated vaporizes or reacts with part of the blasting media 104, depending on if the blasting media 104 comprises a liquid or a solid respectively, creating a steep pressure rise confined in the borehole 122. Because the discharge is very brief, and the rate of temperature increase very quick, a plasma ball on the size of a ping pang ball forms, starting a shock wave with high pressures greater than the material strengths of the solid (on the order of 2.5 GPa) forcing the uncured concrete into the neighboring soils and compacting such soil. The plasma blasting system 100 described herein is able to provide pressures well above the tensile strengths of common rocks (e.g. granite=10-20 MPa, tuff=1-4 MPa, and concrete=7 MPa). Thus, the major cause of the fracturing or breaking of the solid 102 is the impact of this shock wave front which is comparable to one resulting from a chemical explosive (e.g. dynamite) without forming any gases, which prevent wet concrete from filling the space.

As the reaction continues, the blast wave begins propagating outward toward regions with lower atmospheric pressure. As the wave propagates, the pressure of the blast wave front falls with increasing distance. This finally leads to cooling of the plasma and the wet concrete from the upper part of the borehole fills the space created by the blast.

To illustrate the level of generated pressure during testing, the blast probe of the blasting system described herein was inserted into solids comprising either concrete or granite with cast or drilled boreholes having a one inch diameter. A capacitor bank system was used for the electrical storage unit and was charged at a low current and then discharged at a high current via the high voltage switch 112. Peak power achieved was measured in the megawatts. Pulse rise times were around 10-20 μsec and pulse lengths were on the order of 50-100 μsec. The system was able to produce pressures of up to 2.5 GPa and break concrete and granite blocks with masses of more than 850 kg.

FIG. 5 shows an alternative probe 500 embodiment. Probe coupler 501 electrically connects to wires 114 for receiving power from the capacitors 108 and mechanically connects to tethers (could be the wires 114 or other mechanical devices to prevent the probe 500 from departing the bore hole 122 after the blast). The probe coupler 501 may incorporate a high voltage coaxial BNC-type high voltage and high current connector to compensate lateral Lorentz' forces on the central electrode and to allow for easy connection of the probe 500 to the wires 114. The mechanical connection may include an eye hook to allow carabiners or wire rope clip to connect to the probe 500. Other mechanical connections could also be used. The probe connection 501 could be made of plastic or metal. The probe connector 501 could be circular in shape and 2 inches in diameter for applications where the probe is inserted in a bore hole 122 that is the same depth as the probe 500. In other embodiments, the probe 500 may be inserted in a deep hole, in which case the probe connector 501 must be smaller than the bore hole 122.

The probe connector 501 is mechanically connected to the shaft connector 502 with screws, welds, or other mechanical connections. The shaft connector 502 is connected to the probe shaft 503. The connection to the probe shaft 503 could be through male threads on the top of the probe shaft 503 and female threads on the shaft connector 502. Alternately, the shaft connector 502 could include a set screw on through the side to keep the shaft 503 connected to the shaft connector 502. The shaft connector 502 could be a donut shape and made of stainless steel, copper, aluminum, or another conductive material. Electrically, the shaft connector 502 is connected to the ground side of the wires 114. An insulated wire from the probe connector 501 to the high voltage electrode 602 passes through the center of the shaft connector 502. For a 2 inch borehole 122, the shaft connector could be about 1.75 inches in diameter.

The shaft 503 is a hollow shaft that may be threaded 507 at one (or both) ends. The shaft 503 made of stainless steel, copper, aluminum, or another conductive material. Electrically, the shaft 503 is connected to the ground side of the wires 114 through the shaft connector 502. An insulated wire from the probe connector 501 to the high voltage electrode 602 passes through the center of the shaft 503. Mechanically, the shaft 503 is connected to the shaft connector 502 as described above. At the other end, the shaft 503 is connected to the cage 506 through the threaded bolt 508 into the shafts threads 507, or through another mechanical connection (welding, set screws, etc). The shaft 503 may be circular and 1.5 inches in diameter in a 2 inch borehole 122 application. The shaft may be 40 inches long, in one embodiment. At several intervals in the shaft, blast force inhibitors 504*a*, 504*b*, 504*c* may be placed to inhibit the escape of blast wave and the blasting media 104 during the blast. The blast force inhibitors 504*a*, 504*b*, 504*c* may be made of the same material as the shaft 503 and may be welded to the shaft, machined into the shaft, slip fitted onto the shaft or connected with set screws. The inhibitors 504*a*, 504*b*, 504*c* could be shaped as a donut.

The shaft 503 connects to the cage 506 through a threaded bolt 508 that threads into the shaft's threads 507. This allows adjustment of the positioning of the cage 506 and the blast. Other methods of connecting the cage 503 to the shaft 506 could be used without deviating from the invention (for example, a set screw or welding). The cage 506 may be circular and may be 1.75 inches in diameter. The cage 506 may be 4-6 inches long, and may include 4-8 holes 604 in the side to allow the blast to impact the side of the blast hole 122. These holes 604 may be 2-4 inches high and may be 0.5-1 inch wide, with 0.2-0.4 inch pillars in the cage 506 attaching the bottom of the cage 506 to the top. The cage 506 could be made of high strength steel, carbon steel, copper, titanium, tungsten, aluminum, cast iron, or similar materials of sufficient strength to withstand the blast. Electrically, the cage 506 is part of the ground circuit from the shaft 503 to the ground electrode 601.

In an alternative embodiment, a single blast cage could be made of weaker materials, such as plastic, with a wire connected from the shaft to the ground electrode 601 at the bottom of the cage 506.

The details of the cage 506 can be viewed in FIG. 6. A ground electrode 601 is located at the bottom of the cage 506. The ground electrode 601 is made of a conductive material such as steel, aluminum, copper or similar. The ground electrode 601 could be a bolt screwed in female threads at the bottom of the cage 506. Or a nut could be inserted into the bottom of the cage for threading the bolt 601 and securing it to the cage 506. The bolt 601 can be adjusted with washers or nuts on both sides of the cage 506 to allow regulate the gap between the ground electrode bolt 601 and the high voltage electrode 602, depending upon the type of solid 102.

The wire that runs down the shaft 503, as connected to the wires 114 at the probe connector 501, is electrically connected to the high voltage electrode 602. A dielectric separator 603 keeps the electricity from coming in contact with the cage 506. Instead, when the power is applied, a spark is formed between the high voltage electrode 602 and the ground electrode 601. In order to prevent the spark from forming between the high voltage electrode 602 and the cage 506, the distance between the high voltage electrode 602 and the ground electrode 601 must be less than the distance from the high voltage electrode 602 and the cage 506 walls. The two electrodes 601, 602 are on the same axis with the tips opposing each other. If the cage is 1.75 inches in diameter, the cage 506 walls will be about 0.8 inches from the high voltage electrode 602, so the distance between the high voltage electrode 602 and the ground electrode 601 should be less than 0.7 inches. In another embodiment, an insulator could be added inside the cage to prevent sparks between the electrode 602 and the cage when the distance between the high voltage electrode 602 and the ground electrode 601 is larger.

This cage 506 design creates a mostly cylindrical shock wave with the force applied to the sides of the bore hole 122. In another embodiment, additional metal or plastic cone-shaped elements may be inserted around lower 601 and upper electrodes 602 to direct a shock wave outside the probe and to reduce axial forces inside the cage.

The method of and apparatus for plasma blasting described herein has numerous advantages. Specifically, by adjusting the blasting probe's tip and thereby the electrode gap, the plasma blasting system is able to provide better control over the power deposited into the specimen to be broken. Consequently, the power used is able to be adjusted according to the parameters of the soil and of the wet concrete instead of using the same amount of power regardless of the soil and material conditions. As a result, the plasma blasting system is more efficient in terms of energy, safer in terms of its inert qualities, and requires smaller components thereby dramatically decreasing the cost of operation.

While one embodiment of the plasma blasting probe was used to fracture rock or concrete, this new probe design can also be used "down hole" in an uncured ("wet") concrete piling during construction.

The purpose of this plasma blast in this application is to push the portion of the concrete outward. In a soft silty environment this process compacts the soil and shapes the bottom of the concrete into a more anchor like shape. This process can be repeated multiple times by adding more concrete and repeating the blast further "up hole".

Figure 7A:
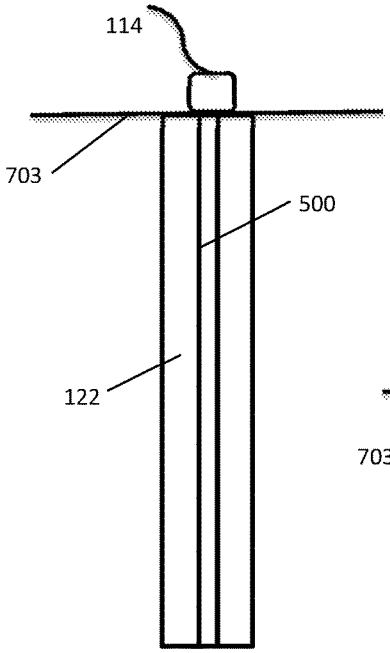
FIG. 7*a* shows a piling hole with the plasma blasting probe in place to create the in-situ shaping before the first blast.

Looking to FIG. 7*a*, there is a borehole 122 drilled into soil 703. The borehole 122 is filled with wet concrete, and before the concrete cures, a probe 500 is inserted into the concrete. In one embodiment, the probe 500 is sent to the bottom of the borehole 122. The probe 500 then creates a plasma blast.

Figure 7B:
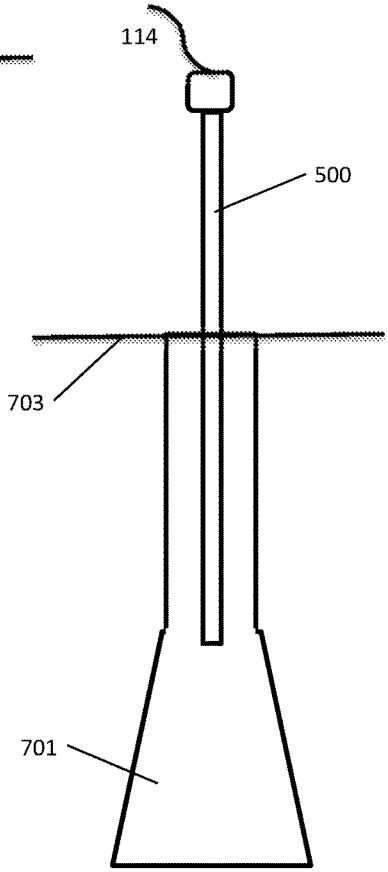
FIG. 7*b* shows a piling hole with the plasma blasting probe in place to create the in-situ shaping after the first blast and in position for the second blast.

FIG. 7*b* shows the borehole 122 after the plasma blast. The bottom of the borehole 122 has been expanded into a shaped cavity 701. The concrete is pushed into the soil, and the soil is compacted, creating a base that will take more weight than a typical piling. Additional concrete is then added to the borehole 122 to replace the concrete that has been driven into the soil.

Figure 7C:
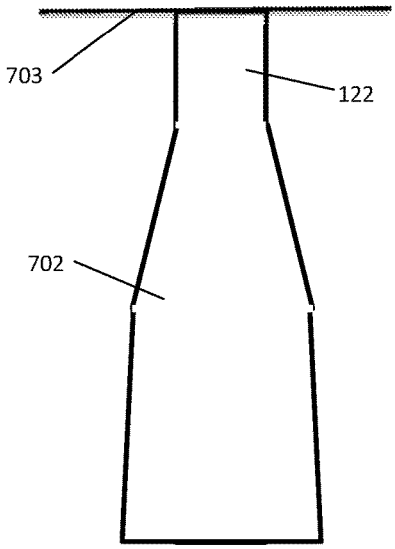
FIG. 7*c* shows a piling hole with the plasma blasting probe in place to create the in-situ shaping after the second blast.

This procedure can be repeated, as seen in FIG. 7*c*, to create a bigger shaped concrete cavity 702. In this example, the probe 500 in FIG. 7*b* is used to create a second plasma blast higher in the borehole 122. The resulting shape 702 is seen in FIG. 7*c*. The procedure can be repeated again until the desired shape is achieved.

It is envisioned that through shaped plasma blasting to force wet concrete into boreholes could create various underground structures for supporting buildings. In one embodiment, the holes could be shaped such that adjacent pilings could be connected underground by expanding the bottom of the boreholes until they interconnect. By connecting the pilings above ground, the pilings will then be connected above ground and below ground, preventing the pilings from tipping over.

In another embodiment, and lattice could be created underground connecting a grid of boreholes. Each of these structures allow for building weight to be distributed across a broad area of soil that would not normally support the weight of the building. In another embodiment, concrete guy wire anchors could be created in a mushroom shape underground structure to prevent the weight of a radio tower from pulling the guy wires out of the ground.

This embodiment allows four new features to be added to customized shaping of the piling anchor.

The first feature is a mechanism that adjusts the spark gap remotely and electronically. In FIG. 6, the electrodes 601, 602 are shown with an adjustable gap between the electrodes. In one embodiment, a small motor is mounted to the top of the cage 506 that will allow the cage 506 to be spun relative to the shaft 503, thus causing the high voltage electrode 602 to move, either increasing or decreasing the gap between the electrodes 601, 602. In another embodiment, the ground electrode 601 could be moved to adjust the gap between the electrodes 601, 602. In some embodiments the motor is a stepper motor. In other embodiments, pneumatic or hydraulic pressure could be used to adjust the gap between the electrodes 601, 602 by turning either the cage 506 or the ground electrode 601. In another embodiment, the pneumatic or hydraulic pressure could be asserted against a spring holding the high voltage electrode 602 (or the ground electrode 601) in place, causing the spring to expand or compact, thus adjudicating the gap between the electrodes 601, 602.

The second feature is to arrange the electrodes in a groups of three 120 degrees apart or four 90 degrees apart or any number with an equal number of opposing electrodes on the same axis on the other side of the probe. In this embodiment, multiple sets of electrodes 601, 602 are mounted in the cage 506, and fired either synchronously or asynchronously in order to shape the blast wave. In another embodiment, the cage 506 could be designed with holes 604 only in certain directions to push the force of the blast in the director of the openings 604.

The third feature is an in situ recognition and sensing of soil conditions surrounding the probe. With this embodiment, sensors could be mounted in the cage 506 or in the shaft 503 to sense the characteristics of the soil surrounding the borehole 112. These sensors could report the soil conditions back to an operator to allow the operator to determine the energy used in the blast, the distance between the electrodes 601B, 602B, and the direction of the blast.

The fourth feature is a smart algorithm which analyzes and synthesizes the soil information and desired shape and adjusts the spark gap and determines which electrodes will fire. The smart algorithm also can adjust the amount of energy (electricity) used in the blast. This embodiment would require a special purpose microprocessor designed to interface with the capacitor bank 108 and the high voltage, high speed switch 112. The special purpose microprocessor may also take input from the soil sensors and operate the mechanism to adjust the gap between the electrodes 601, 602. The algorithm takes the desired shape of the resulting hole 702 and the soil conditions from the sensors in the probe 500, and calculates the direction and power of the blast waves required to create the desired shape. The special purpose microprocessor then automatically adjusts the gap between the electrodes 601, 602, and the direction of the blast through which electrodes fire and with what power. The special purpose microprocessor then determines how deep in the borehole 122 that the probe 500 should be inserted. The special purpose microprocessor then determines the amount of electrical energy and the time of discharge.

The result is a customizable in-situ shaping of the concrete piling which can be asymmetric in shape to match the varying soil conditions as a function of depth.

The present invention has been described in terms of specific embodiments incorporating details to facilitate the understanding of principles of construction and operation of the invention. Such reference herein to specific embodiments and details thereof is not intended to limit the scope of the claims appended hereto. It will be readily apparent to one skilled in the art that other various modifications may be made in the embodiment chosen for illustration without departing from the spirit and scope of the invention as defined by the claims.

The foregoing devices and operations, including their implementation, will be familiar to, and understood by, those having ordinary skill in the art.

The above description of the embodiments, alternative embodiments, and specific examples, are given by way of illustration and should not be viewed as limiting. Further, many changes and modifications within the scope of the present embodiments may be made without departing from the spirit thereof, and the present invention includes such changes and modifications.

The invention claimed is:

1. A method of creating a piling in soil, comprising the steps of:

creating a borehole in the soil;

filling the borehole with wet concrete;

inserting a plasma blasting probe into the borehole, wherein the plasma blasting probe comprises a cage and a plurality of electrodes, wherein at least two of the plurality of electrodes are separated by a dielectric separator, and wherein the dielectric separator and at least one of the at least two of the plurality of electrodes constitute an adjustable probe tip with a maximum gap between the electrodes less than the gap between any of the electrodes and the cage enclosing the electrodes;

creating a plasma explosion in the borehole using the plasma blasting probe;

removing the plasma blasting probe from the borehole; and adding additional concrete into the borehole.

2. The method of claim 1, further comprising the step of inserting rebar in the borehole.

3. The method of claim 2, wherein the rebar is inserted before the plasma explosion.

4. The method of claim 2, wherein the rebar is inserted after the plasma explosion.

5. The method of claim 1, wherein a plurality of plasma explosions are created in the borehole.

6. The method of claim 1, wherein a plurality of boreholes are created in close proximity such that the concrete in at least two boreholes interconnects.

7. The method of claim 6, wherein the plurality of boreholes forms a lattice.

8. The method of claim 1, wherein the plasma explosion is shaped to create a mushroom shape.

9. The method of claim 8, wherein guy wire attachments are inserted in the concrete.

10. The method of claim 1, further comprising testing soil conditions with sensors attached to the plasma blasting probe.

11. The method of claim 10, further comprising calculating an amount of energy, a duration of the energy and a gap between electrodes mounted in the plasma blasting probe to form a specific shape with the plasma explosion.

12. The method of claim 11, wherein the calculating is performed with a special purpose microprocessor.

13. The method of claim 12, wherein the special purpose microprocessor further calculates a depth of the plasma explosion.

14. The method of claim 12, further comprising electronically adjusting the amount of the energy and the duration of the energy by the special purpose microprocessor.

15. The method of claim 1, wherein the cage is a symmetrical cage.

16. The method of claim 15, wherein said electrodes are connected to at least one capacitor, and said electrodes are on an axis with tips opposing each other.

17. A blast probe apparatus for forming shaped concrete pilings comprising a symmetrical cage;

a plurality of electrodes, said electrodes connected to at least one capacitor, wherein at least two of the plurality of electrodes are separated by a dielectric separator, and wherein the dielectric separator and at least one of the at least two of the plurality of electrodes constitute an adjustable probe tip with a maximum gap between the electrodes less than the gap between any of the electrodes and the cage enclosing the electrodes, said electrodes on an axis with tips opposing each other;

at least one soil condition sensor attached to the symmetrical cage;

a special purpose microprocessor in communication with the at least one soil condition sensor and the electrodes, wherein the special purpose microprocessor controls an amount of energy and a duration of the energy sent through the electrodes.

18. The blast probe apparatus of claim 17, further comprising wet concrete in the cage between the electrodes.

19. The blast probe apparatus of claim 17, further comprising a motor attached to one of the electrodes and in communication with the special purpose microprocessor.

* * * * *